United States Patent [19]

Sabranski et al.

[11] Patent Number: 4,928,598

[45] Date of Patent: May 29, 1990

[54] PROPELLING CHARGE CASE

[75] Inventors: Udo Sabranski, Willich; Hans W. Luther, Kaarst; Horst Sabinski, Kaarst; Jürgen Winkelmann, Kaarst, all of Fed. Rep. of Germany

[73] Assignee: Rheinmetall GmbH, Dusseldorf, Fed. Rep. of Germany

[21] Appl. No.: 338,530

[22] Filed: Apr. 14, 1989

Related U.S. Application Data

[63] Continuation-in-part of Ser. No. 61,348, Jun. 15, 1987, abandoned.

[30] Foreign Application Priority Data

Jun. 13, 1986 [DE] Fed. Rep. of Germany ..... 3619960

[51] Int. Cl.[5] ..... F42B 5/26

[52] U.S. Cl. ..... 102/467; 102/431; 102/465; 102/469; 102/700

[58] Field of Search ..... 102/430, 431, 432, 433, 102/464, 465, 466, 467, 469, 470, 520, 521

[56] References Cited

U.S. PATENT DOCUMENTS

| | | | |
|---|---|---|---|
| 2,991,168 | 7/1961 | Nadel . | |
| 3,095,813 | 7/1963 | Lipinski | 102/465 |
| 3,164,090 | 1/1965 | Williams et al. | 102/467 |
| 3,170,401 | 2/1965 | Johnson et al. | 102/467 |
| 3,617,593 | 11/1971 | Alderfu | 102/700 |
| 3,696,748 | 10/1972 | Picard et al. | 102/431 |
| 3,706,279 | 12/1972 | Zimmerman | 102/465 |
| 3,955,506 | 5/1976 | Luther et al. | 102/467 |
| 3,981,246 | 9/1976 | Luther et al. | 102/521 |
| 4,159,678 | 7/1979 | Luther et al. | 102/467 |

FOREIGN PATENT DOCUMENTS

| | | | |
|---|---|---|---|
| 527369 | 10/1956 | Belgium | 102/464 |
| 341861 | 10/1921 | Fed. Rep. of Germany . | |
| 1446889 | 4/1969 | Fed. Rep. of Germany . | |
| 1453842 | 6/1970 | Fed. Rep. of Germany . | |
| 1578153 | 9/1970 | Fed. Rep. of Germany . | |
| 2641665 | 3/1978 | Fed. Rep. of Germany . | |
| 3332675 | 3/1985 | Fed. Rep. of Germany | 102/521 |

*Primary Examiner*—Harold J. Tudor
*Attorney, Agent, or Firm*—Spencer & Frank

[57] ABSTRACT

A propelling charge case for a munition, which charge case has a body made of nonwoven nitrocellulose-based fibers and formed to have an axial cross section with at least one curved portion, and a reinforcement member of metal or plastic assembled with the body at the curved portion and configured to not interfere with residue-free combustion of the body.

22 Claims, 4 Drawing Sheets

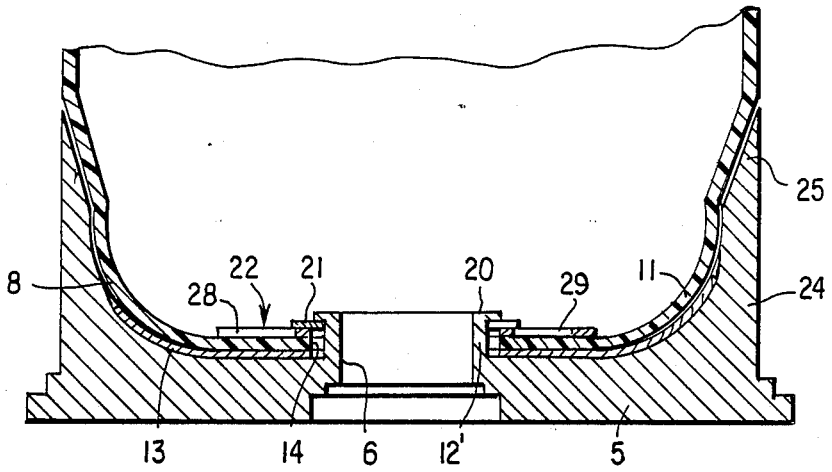
FIG. 10
FIG. 11
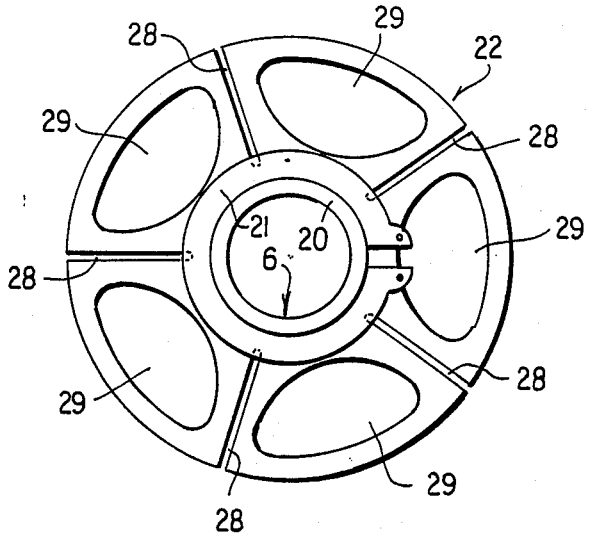
FIG. 12
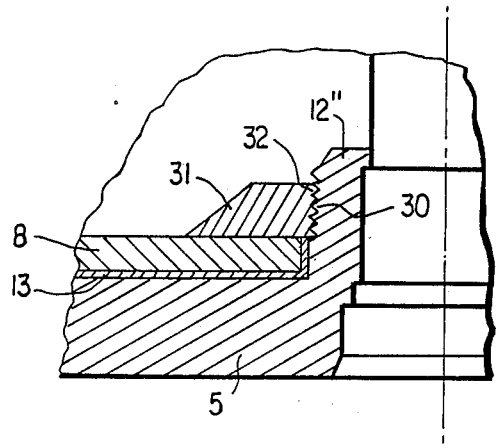

PROPELLING CHARGE CASE

This application is a continuation-in-part of application Ser. No. 061,348, filed June 15, 1987, now abandoned.

BACKGROUND OF THE INVENTION

The present invention relates to a propelling charge case having a body made of nonwoven nitrocellulose-based fibers.

FRG-AS 1,446,889 discloses the production of propelling charge cases based on nitrocellulose, with a fiber web being produced on a suction tool, and the web being additionally impregnated after drying.

German Patent No. 1,453,842 discloses a propelling charge case which has a tubular body made of a fiber web based on nitrocellulose which is clamped in between outer and inner connecting cups disposed at the base, with the inner connecting cup being perforated to ensure combustion of the fiber web without residue. The outer connecting cup is inserted into a base. However, this requires a relatively complicated structure for the base region of the propelling charge case.

Additionally, German Patent No. 341,861 discloses reinforcement of the base of a propelling charge case by means of a reinforcement ring, while FRG-OS 1,578,153 provides, in a propelling charge case for hunting cartridges, an axial and radial metal insert serving as reinforcement for the case base and the opening for the igniter capsule.

Propellant charge cases having a body made of a nitrocellulose-based fiber web have the advantage of low specific weight and residue-free combustion in the gun barrel under pressure and temperature. Moreover, no "empties" are encountered in the combat areas and additionally the CO concentration is very low compared to metal cases. However, they have the drawback that the inherent strength of this material cannot be increased without adversely affecting the above-mentioned advantages. This limits their use, particularly for large caliber ammunition, for example, military ammunition carried in tanks, which is subjected to considerable mechanical stresses during loading and unloading and due to shocks and vibration. This may damage the fiber web at its weak points or may destroy it. The consequences are difficulties in loading or unloading and also the loss of propelling charge powder. All this constitutes a danger for the soldier.

SUMMARY OF THE INVENTION

It is an object of the present invention to provide a propelling charge case of the above-described type in which the mechanical stresses to be expected do not produce damage and residue-free combustion of the fiber web is retained.

The above and other objects are achieved, according to the invention, in a propelling charge case for a munition, which charge case has a body made of nonwoven nitrocellulose-based fibers and is formed to have an axial cross section with at least one curved portion, by the improvement comprising a reinforcement member of metal or plastic assembled with the body at the curved portion and configured to not interfere with residue-free combustion of the body.

This arrangement ensures that the reinforcements for the weak points in the propelling charge case, which are connected with the fiber web, do not remain in the gun barrel. These reinforcements may be appropriately embedded in the forming tool during the manufacturing process.

The invention will now be described in greater detail with reference to embodiments that are illustrated in the attached drawing figures.

BRIEF DESCRIPTION OF THE DRAWING

FIG. 10 is a cross-sectional view of the lower portion of a propelling charge case according to the invention showing an alternative fastening arrangement for connecting the portions of the casing together.

FIG. 11 is a plan view of the fastening arrangement of FIG. 10.

FIG. 12 is a partial cross-sectional view showing still a further arrangement for fastening the body to the base.

DESCRIPTION OF THE PREFERRED EMBODIMENTS

Figure 1:
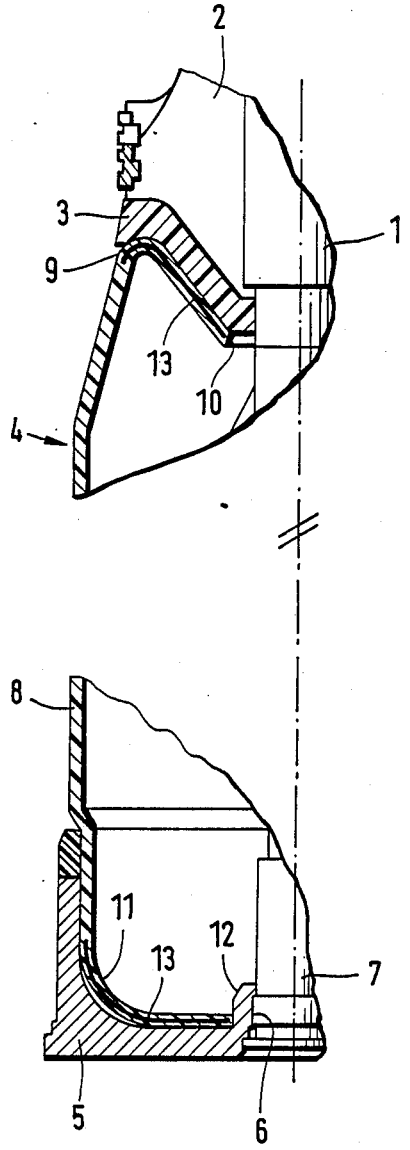
FIG. 1 is a cross-sectional detail view of part of a projectile and propelling charge case according to the invention.

FIG. 1 shows a portion of a munition including a projectile 1 having a sabot 2 which is connected by way of an annular seal 3 with a propelling charge case 4. The propelling charge case 4 is composed of a reusable cylindrically symmetrical metal base 5 having a cup shaped recess and is provided with a bore 6 to accommodate an igniter capsule 7. Moreover, propelling charge case 4 is composed of a body or container 8 made of a nitrocellulose-based fiber web for containing the propellant for the projectile. Adjacent to seal 3, body 8 has an inwardly acutely curved portion 9 whose inner end delimits a bore 10 through which extends projectile 1. Portion 9 may extend at right angles to the axis of the munition, for example if a projectile 1 without a sabot is accommodated by propelling charge case 4. Additionally, body 8 has a curved portion 11 in the region of base 5 to adapt case 4 to the internal curvature of base 5. Curved portion 11 extends at the base end to a collar 12 in the center of base 5 which collar defines bore 6. That is, the diameter of the axial bore, aperture or hole provided in the bottom of the body 8 substantially corresponds to the diameter of the outer circumference of the collar 12.

Weak points in body 8, which are endangered by mechanical stresses, are located at portions 9 and 11 and in the regions around bore 10 and center or axial collar 12. According to the invention, reinforcements 13 of metal or plastic are provided in these regions.

Figure 2:
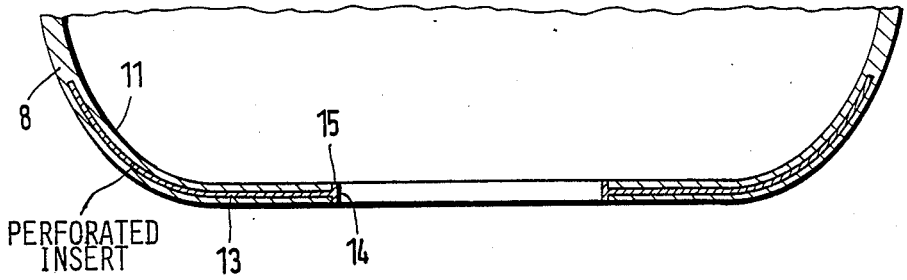
FIG. 2 is an enlarged cross-sectional detail view of the base region of the propelling charge case of FIG. 1.
Figure 3:
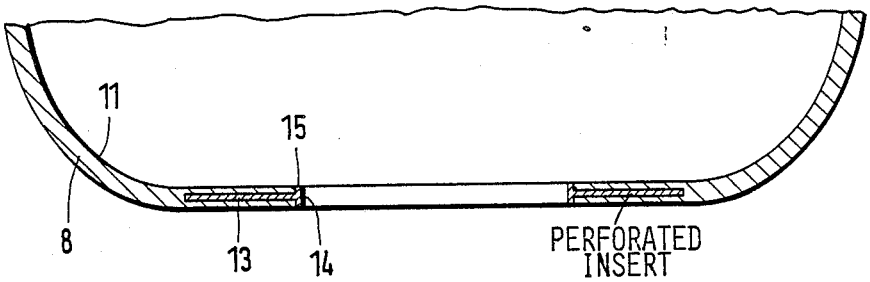
FIGS. 3 to 9 are cross-sectional detail views of the base regions of further embodiments of propelling charge cases according to the invention.
Figure 9:
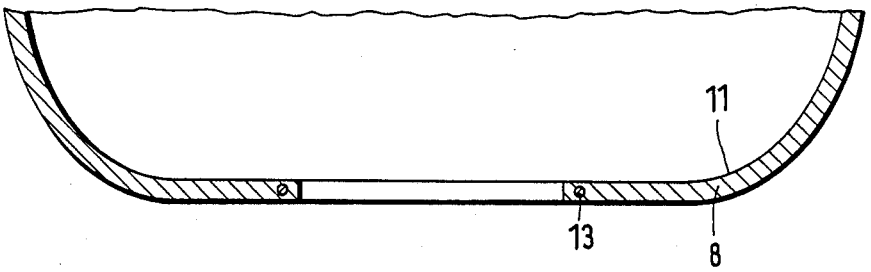

In the embodiment shown in FIG. 2, reinforcement 13 is a perforated insert of sheet metal or plastic extending across portion 11 and to the region of collar 12. Since base 5 protects portion 11 of body 8, reinforcement 13 may possibly be provided only around bore 14 surrounding center pin 12, as is shown in FIG. 3. Possibly, a reinforcement 13 in the form of a reinforcing ring adjacent, and surrounding, bore 14 would also be sufficient, as shown in FIG. 9. In the embodiments shown in FIGS. 2 and 3, reinforcement 13 includes an inner ring 15 which delimits bore 14.

Figure 4:
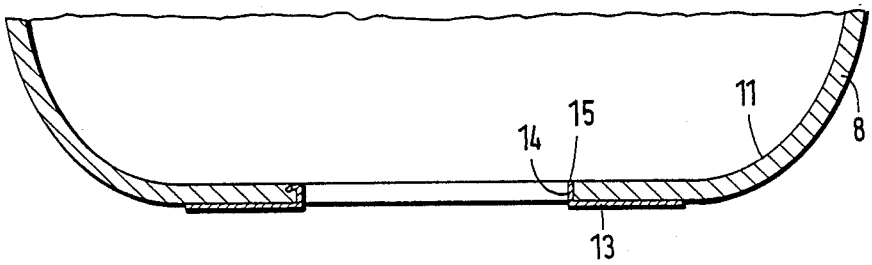

In the embodiment shown in FIG. 4, reinforcement 13 is not embedded in body 8, as in FIGS. 2 and 3, but is a pad having an L-shaped cross section which is attached to the outer surface of body 8 by gluing or, as shown in the left half of FIG. 4, by rolling the short leg of the L shape into the body 8. Here again, reinforcement 13 may be inserted into the suction tool for production of body 8. Since in the embodiment of FIG. 4, reinforcement 13 is disposed only on the exterior surface of body 8, no passages or perforations through reinforcement 13 are required since the residue-free combustion of body 8 is ensured.

Figure 5:
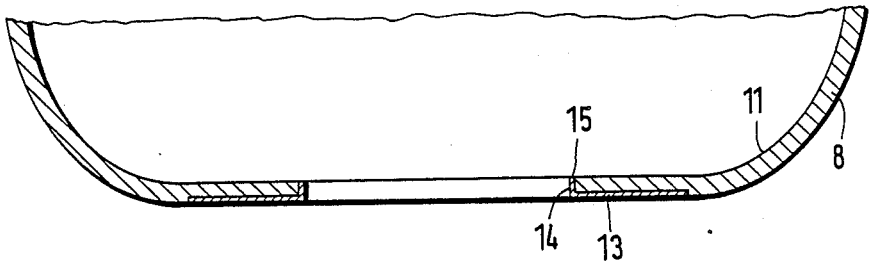

In the embodiment shown in FIG. 5, reinforcement 13 has an L-shaped cross section and is worked into the outer wall of body 8 so that body 8 has essentially the same wall thickness everywhere. The recess in the surface of body 8 required for this purpose is produced by mechanical working. Since due to this mechanical working, the region of body 8 which has the highest strength and density is removed while the felt-like center region of body 8 remains, subsequent impregnation of the remaining portion of body 8 in the region of reinforcement 13 is advisable to strengthen the body. Subsequent impregnation is known in the art. For example, the body 8 in the region of reinforcement 13 may be immersed in a vessel containing a 20% polystyrene in toluene. The molded body thus impregnated is then taken from the vessel and the excess solution removed.

Figure 6:
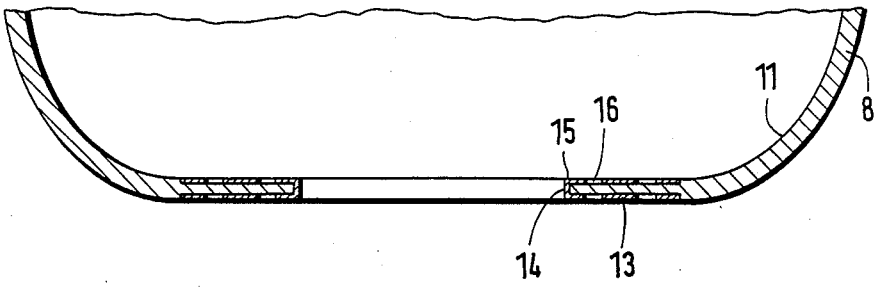

In the embodiment shown in FIG. 6, reinforcement 13 has a U-shaped cross section and is clamped around body 8 in the region of bore 14, with reinforcement 13 being provided with holes or perforations 16, at least on its interior leg, to ensure residue-free combustion of body 8. In this case, reinforcement 13 is arranged to be flush with the exterior face of body 8, similar to the embodiment of FIG. 5, and body 8 is advisably subsequently impregnated in this region.

Figure 7:
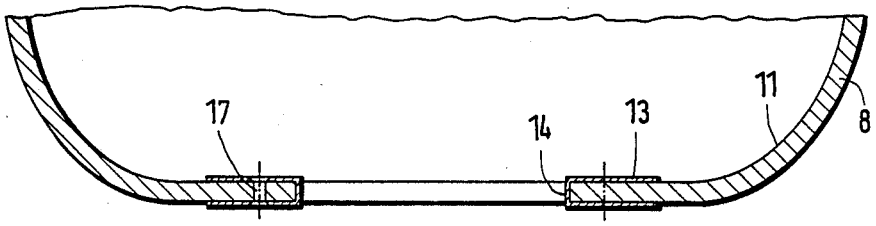

As shown in FIG. 7, reinforcement 13, which also has a U-shaped cross section, and thus is provided with perforations at least on its interior leg, may be fastened to the body 8 by means of rivet or screw connections 17.

Figure 8:
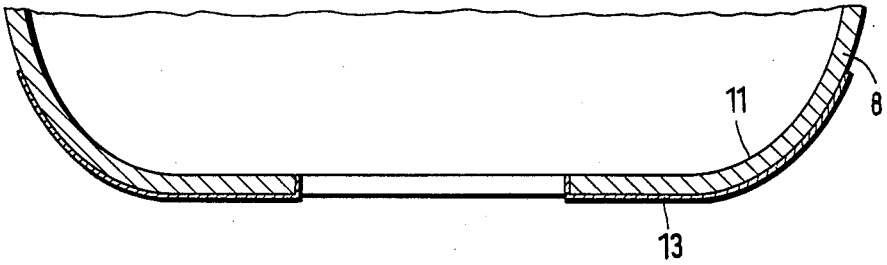

As indicated in FIG. 8, reinforcement 13 may be composed of woven metal or plastic and disposed against the outer wall or surface of body 8.

The reinforcement 13 shown at the upper end of case 4 in FIG. 1 can be constructed in a manner similar to any of the embodiments shown in FIGS. 2–9.

Body 8 can be made of any nitrocellulose-based material customarily used for such propelling cases.

As indicated above, in the arrangement of FIG. 1 the diameter of the bore 14 defined by the edge of the body or container 8, which edge preferably is covered by a portion of the reinforcement member 13, corresponds to the outer diameter of the cylindrical collar or pin 12 so that the edge engages or contacts the outer circumference or circumferential surface of the collar 12. This arrangement makes it possible to fasten the combustible propelling charge body 8 with its attached reinforcing member 13 to the non-combustible base 5 by gluing same together by a suitable adhesive disposed at least in the substantially horizontal region adjacent the collar 12 and extending radially approximately to the curved region 11. However, different and alternative arrangements for fastening the body 8 and the base 5 together can be used.

One such alternative arrangement for fastening the combustible propelling charge body or container 8 according to the present invention, i.e., with the reinforcement element 13 fixedly attached thereto, to the base 5 is shown in FIG. 10. According to FIG. 10, the body 8 with its reinforcement element or member 13 is as essentially shown in FIG. 8, but the other illustrated embodiments may be used. The illustrated fastening arrangement is disclosed in U.S. Pat. No. 4,159,678, issued July 3rd, 1979.

As shown, the base 5 is provided with an axial collar or pin 12′ whose outer circumference is slightly undercut over a portion of its length so as to provide a radial flange 20 at its front end. In this embodiment, the diameter of the bore 14 corresponds or is equal to the outer diameter of the pin 12′, i.e., the outer diameter of the flange portion 20, so that a small annular gap exists between the edge of the body or container 8 covered by the reinforcing element 13 (and defining bore 14) and the circumference of the undercut portion of the collar or pin 12′. The body or container 8 is in turn fastened to the base 5 via a flat elastic disk or plate 22, for example, of resilient sheet metal and a retaining ring 21 (Seeger circlip ring) which fits beneath the exterior flange 20 at the upper end of the central pin, collar or bearing 12′. Via the central bore 6 in the center or axial pin or collar 12′, an ignition element (not shown in the drawing), i.e., the primer, is inserted into the base 5 of the propelling charge case. It should be noted that in addition to the illustrated fastening arrangement, the other fastening arrangements disclosed in U.S. Pat. No. 4,159,678 can equally well be used with the present invention.

The noncombustible base 5 of the casing 4 may be made of metal or entirely of temperature-resistant plastic. The cylindrical case shaft or rim 24 of the case base 5 is provided on the frontal side with a conical tip 25. That is, the inner surface of the case shaft 24 adjacent the frontal end tapers or extends obliquely toward the exterior. The purpose of this conical tip 25 is to seal off gas from the interior wall of the weapon barrel by means of the elasticity of the case tip.

FIG. 11 is a plan view of the resilient disk or plate 22 and the safety or retaining ring 21 extending beneath the flange 20 of the center or axial collar 12′. As shown, the disk 22 is provided with a plurality of radial slits 28 and a plurality of recesses 29 which serve the purpose of increasing the elasticity and flexibility of the resilient disk 22 to shock-like stresses exerted on the base 5 and propelling charge body or container 8 (including propelling charge powder and projectile) and additionally of ensuring the undisrupted combustion of the propelling charge case 8 in the region beneath the disk 22.

With this arrangement, subsequent to combustion of the body or container 8 the reinforcement 13, if made of non-combustible metal, e.g., brass, remains clamped to the axial collar 12′ by means of the resilient disk 22 and the safety ring 21, and thus can be removed from the weapon barrel together with the base 5 subsequent to firing.

According to a further arrangement as shown in FIG. 12, the base 5 is provided with an axial collar or pin 12″ having a screw thread 30 on at least the upper portion of its outer circumference, and the body 8 is securely fastened to the bases 5 by a clamping nut 31 having an internal thread 32 which engages the external thread 30. In this embodiment, as in the embodiment of FIG. 1, the diameter of the bore 14 corresponds to the outer diameter of the collar 12″ so that no, or substantially no, annular gap is provided between the reinforcement covered inner edge of the body 8 and the circumferential surface of the collar 12″.

The reinforcement element or member 13 is provided in this region so that during manipulation of the munition no cracks or other damage will occur under or around the clamping nut 31 on account of the effective bending load and tensile strain in the fastening region. Great tensile strains in this region occur, for example, if loaded munitions are not fired and must be unloaded, i.e. removed from the tube or barrel of the weapon. With this arrangement as well, the reinforcing member 13, if made of metal, will remain clamped to the collar 12" after firing.

The reinforcement element or member 13 may be made, for example, of metal-wire mesh (wire lattice), steel wire, or, for example, brass. However, the reinforcement element 13 may also be made of a plastic mesh, for example, of polyethylene polyamide (PA) or polyvinyl chloride (PVC) or a fiber glass web combined with this plastic material.

The wall thickness of the combustible propelling charge container 8 is generally approximately 3 mm. In the relevant fastening region, however, the thickness of the material of the propelling charge container 8 may also be approximately 4 to 5 mm. The material thickness of the reinforcement member 13 should be approximately 1 to 1.5 mm.

The invention now being fully described, it will be apparent to one of ordinary skill in the art that many changes and modifications can be made thereto without departing from the spirit or scope of the invention as set forth herein.

What is claimed is:

1. In a propelling charge case for a munition, which charge case has a body which is made of nonwoven nitrocellulose-based fibers, which is to be fastened to a noncombustible base having an axial collar, and which is formed to have an axial bore in one end of a size corresponding substantially to that of the outer circumference of the collar and a radially inwardly curved portion which extends to an edge surface defining said bore; the improvement wherein said body further comprises a reinforcement member, formed of one of metal and plastic, which is fixedly attached to said body, and which is disposed around said bore and extends from said edge surface toward said curved portion, whereby when said charge case is disposed in the base, the axial collar extends through said bore and a portion adjacent a portion of said body which is reinforced by said reinforcement member.

2. A propelling charge case as defined in claim 1 wherein said reinforcement member is embedded in said body.

3. A propelling charge case as defined in claim 2 wherein said reinforcement member further includes a ring portion which is disposed on said edge surface defining the bore.

4. A propelling charge case as defined in claim 2 wherein said reinforcement member is provided with holes in said curved portion.

5. A propelling charge case as defined in claim 4 wherein said reinforcement member comprises a ring which borders the bore.

6. A propelling charge case as defined in claim 1 wherein said reinforcement member includes a ring portion which borders the bore.

7. A propelling charge case as defined in claim 6 wherein said reinforcement member has a U-shaped cross section and is clamped around said body.

8. A propelling charge case as defined in claim 7 further comprising mechanical connecting means composed of rivets or screws fastening said reinforcement member to said body.

9. A propelling charge case as defined in claim 7 wherein said body has an outer surface, said reinforcement member has an outer surface, said reinforcement member is assembled attached to said body so that a portion of said outer surface of said reinforcement member is flush with said outer surface of said body, and said body is impregnated with a strengthening substance in the region of said reinforcement member.

10. A propelling charge case as defined in claim 7 wherein said reinforcement member is a woven structure.

11. A propelling charge case as defined in claim 6 wherein said reinforcement member is a woven structure.

12. In a propelling charge casing for a munition, which casing includes a cylindrically symmetrical base having a first end and a second end, with said first end being internally curved to form a cup shaped recess and with said second end including an axially centered collar means, having an outer circumference, for the connection of an igniter capsule and with said collar means projecting into the recess, a body for enclosing a propellant with said body being made of nonwoven nitrocellulose-based fibers and with a portion of said body being disposed within said cup shaped recess and configured to the curvature of said cup shaped recess, said body including a bore through which said collar means extends, and fastening means for fastening said body to said base; the improvement wherein: an edge of said body forming said bore extends to said outer circumference of said collar means; and said body further includes a reinforcement member which is fixedly attached to said body of nonwoven fibers, which is disposed along a portion of said body located in said cup shaped recess, and which extends radially to and surrounds said edge of said body.

13. A casing as defined in claim 12, wherein said body includes an outer surface and an inner surface and said reinforcement member is disposed on at least one of said inner and said outer surfaces of said body.

14. A casing as defined in claim 13, wherein a first portion of said reinforcement member is disposed on said edge of said body forming said bore.

15. A casing as defined in claim 13, wherein said reinforcement member is disposed on said outer surface of said body and extends from said bore to the curved region of said cup shaped recess.

16. A casing as defined in claim 12, wherein said reinforcement member extends from said bore to the curved region of said cup shaped recess.

17. A casing as defined in claim 16, wherein said reinforcement member is embedded in said body and is provided with perforations.

18. A casing as defined in claim 13 wherein said reinforcement member is disposed on said inner surface of said body and is provided with holes.

19. A casing as defined in claim 13, wherein said reinforcement means is disposed on said outer surface of said body and further includes a ring portion disposed on said edge of said body.

20. A casing as defined in claim 12 wherein said fastening means is connected to said collar means.

21. A casing as defined in claim 14 wherein said portion of said reinforcement member disposed on said edge of said body engages said outer circumference of said collar means.

22. A casing as defined in claim 12 wherein said base includes a cylindrical rim portion and wherein the inner surface of said rim portion adjacent its frontal tip is conically tapered.

* * * * *